US005900395A

United States Patent [19]

Nicholson et al.

[11] Patent Number: 5,900,395

[45] Date of Patent: May 4, 1999

[54] MACHINE DISHWASHING TABLETS CONTAINING AN OXYGEN BLEACH SYSTEM

[75] Inventors: John Richard Nicholson, Ramsey; Bozena Marianna Piatek, Cedar Grove, both of N.J.; David John Lang, Ossining, N.Y.; Isaac Israel Secemski, Teaneck, N.J.

[73] Assignee: Lever Brothers Company, New York, N.Y.

[21] Appl. No.: 08/780,063

[22] Filed: Dec. 23, 1996

[51] Int. Cl.[6] ..... C11D 3/386; C11D 3/395; C11D 3/08

[52] U.S. Cl. ..... 510/224

[58] Field of Search ..... 510/222, 224, 510/226, 233, 294, 298, 300, 305, 309, 311, 315, 362, 446, 475

[56] References Cited

U.S. PATENT DOCUMENTS

| | | | |
|---|---|---|---|
| 4,683,072 | 7/1987 | Holdt et al. | 252/102 |
| 4,828,749 | 5/1989 | Kruse et al. | 252/135 |
| 4,897,212 | 1/1990 | Kruse et al. | 252/99 |
| 5,039,447 | 8/1991 | Ruben | 252/186.22 |
| 5,133,892 | 7/1992 | Chun et al. | 252/90 |
| 5,200,236 | 4/1993 | Lang et al. | 427/213 |
| 5,292,447 | 3/1994 | Venturello et al. | 252/102 |
| 5,294,362 | 3/1994 | Venturello et al. | 252/102 |
| 5,358,655 | 10/1994 | Kruse et al. | 252/95 |
| 5,374,369 | 12/1994 | Angevaare et al. | 252/102 |
| 5,407,594 | 4/1995 | Fry et al. | 252/90 |
| 5,422,028 | 6/1995 | Oakes et al. | 252/102 |
| 5,453,216 | 9/1995 | Kellett et al. | 252/174.13 |
| 5,468,410 | 11/1995 | Angevaare et al. | 252/95 |
| 5,480,576 | 1/1996 | Gary et al. | 252/95 |
| 5,480,577 | 1/1996 | Nicholson et al. | 252/174.13 |
| 5,624,892 | 4/1997 | Angevaare et al. | 510/223 |
| 5,663,133 | 9/1997 | Goldstein et al. | 510/224 |
| 5,691,293 | 11/1997 | Kruse et al. | 510/224 |
| 5,698,505 | 12/1997 | Ofosu-Asante | 510/221 |
| 5,705,465 | 1/1998 | Angevaare et al. | 252/102 |

FOREIGN PATENT DOCUMENTS

| | | |
|---|---|---|
| 224135 | 6/1987 | European Pat. Off. . |
| 226470 | 6/1987 | European Pat. Off. . |
| 0224128 | 1/1991 | European Pat. Off. . |
| 224128 | 1/1991 | European Pat. Off. . |
| 0224136 | 3/1991 | European Pat. Off. . |
| 224136 | 3/1991 | European Pat. Off. . |
| 4112075 | 9/1993 | Germany . |
| 4229650 | 1/1994 | Germany . |
| 9115568 | 10/1991 | WIPO . |
| 93/00419 | 1/1993 | WIPO . |
| 9300419 | 1/1993 | WIPO . |
| 95/12653 | 5/1995 | WIPO . |
| 95/12654 | 5/1995 | WIPO . |
| 95/12657 | 5/1995 | WIPO . |
| 97/03177 | 1/1997 | WIPO . |

*Primary Examiner*—Kery Fries
*Attorney, Agent, or Firm*—Neil Y. Gilbert

[57] ABSTRACT

A solid detergent composition useful for machine dishwashing is described. The product contains a first layer having an oxygen bleach system, a buffering system, a builder, and an enzyme. The first layer dissolves to deliver a pH of about 8.5 to about 11 in the wash water. A second layer includes an effective amount of an acidity agent and a continuous medium having a melting point in the range of from about 35° C. to about 50° C. The material may be a paraffin wax, a natural wax, a polyvinyl ether, fatty acids and mixtures thereof. The second layer dissolves in wash water to deliver a pH of from about 6.5 to about 9. The release order of the functional ingredients allows for a high level of peracid species generation in the initial wash stages followed by optimum bleaching throughout the wash.

11 Claims, No Drawings

MACHINE DISHWASHING TABLETS CONTAINING AN OXYGEN BLEACH SYSTEM

FIELD OF THE INVENTION

The invention relates to machine dishwashing detergents in solid tablet form having a first layer containing an oxygen bleaching system with or without a bleach catalyst and a buffering system, enzymes, builder and second layer containing an acidity source in a continuous medium to optimize the functionality of the active ingredients and provide excellent overall cleaning performance including glass appearance.

BACKGROUND OF THE INVENTION

The share of machine dishwashing tablets in certain markets has grown significantly in recent years primarily because they are perceived to be more convenient than alternative product forms such as powders. However, the product form and method of delivery of tablets can limit both the type of functional ingredients incorporated and the level of functionality from these ingredients.

A complication unique to tablets derives from the method of introduction into the machine. Thus, some tablets are designed to be placed directly into the machine itself, such as in a basket hanging from the upper rack, where they come into contact with a water spray as soon as the machine starts, while others are delivered via the dispenser and are only released during the main wash cycle. Clearly, the release and performance of functional ingredients will differ depending on how the tablet is delivered.

Each type of delivery has potential weaknesses. Thus, for tablets that come into immediate contact with the water spray, some of the functional ingredients can be released into the pre-wash where, if the temperature is too low the ingredients will be lost without delivering a significant benefit. For both types of tablets, complete dissolution may not occur during the main wash cycle. If part of the tablet is still available for dissolution in the rinse, serious spotting and filming problems can occur. These potential negatives are specific to the tablet form. Liquids or powders are introduced into the wash via the dispensing cup and so there are no losses during the pre-wash and the rapid rate of dissolution of these products ensures no carry over of undissolved product into the rinse. Current tablet technology is not consistently successful in meeting the performance standards of other product forms by ensuring that all the functional ingredients are delivered during the appropriate part of wash cycle.

Prior art attempts to optimize the performance of tablet technology have primarily been directed towards modification of the dissolution profile of tablets. This is deemed especially important for those tablets that are placed in the machine such that they come into contact with a water spray at the very beginning of the wash process. A number of patents suggest technology to minimize dissolution in the pre-wash to allow the maximum amount of functional ingredients to operate in the main wash. In particular, a 2-layer tablet for machine dishwashing is described in EP 224128. Both layers contain metasilicate and triphosphate but by modifying the degree of hydration one layer is cold water soluble while the other layer dissolves rapidly at increasing temperatures.

Similarly, EP 224135 describes a combination of a cold water-soluble melt or tablet with a cold water-resistant melt or tablet that is soluble at increasing water temperatures. The cold water-soluble melt composition consists of a mixture of metasilicate monohydrate, pentahydrate and anhydrous metasilicate and the cold water-resistant tablet layer consists of metasilicate nonahydrate and triphosphate. EP 224136 describes similar compositions in the form of multi-layer fused blocks in which the layers have different dissolution rates. One layer consists of metasilicates having different degrees of hydration and another layer consists predominantly of sodium metasilicates and anhydrous sodium tripolyphosphate.

Phosphate-free tablets containing a combination of metasilicates, a low foaming surfactant, sodium acrylate, sodium carbonate, sodium sulfate, a bleaching agent and water are described in WO 9115568. These tablets are claimed to be 10–40% soluble in the cold water pre-rinse leaving 60–90% for the main wash.

WO 9300419 describes production of phosphate- and metasilicate-free tablets. Anhydrous sodium carbonate and optionally other builders are mixed with acrylate and water sufficient for partial hydration of the anhydrous carbonate. The remaining components are added and the whole compressed into a tablet. The advantage is that the tablets only partially dissolve during the pre-wash stage so that greater than 50% is available for the main wash. Similar technology is described in DE 4112075.

A broad solubility profile for tablets is described in EP 26470. The tablets contain preferred ratios of anhydrous and hydrated metasilicates and anhydrous triphosphate, active chlorine compounds and a tabletting aid consisting of a mixture of sodium acetate and spray-dried sodium zeolite. Good solubility in warm water makes at least 65% of the tablet available for the cleaning stage of the wash.

DE 4229650 describes a tablet with rapid dissolution. Anhydrous sodium tripolyphosphate is partially hydrated to tripolyphosphate hexahydrate and the partial hydrate is mixed with powdered water-free silicate, sprayed with water or aqueous silicate, granulated and mixed with optional cleaning components. Tabletting auxiliaries sodium metasilicate pentahydrate and/or nanohydrate comprising of about 8–12% of the total granulate mix are included.

Thus, in terms of optimizing the performance of machine dishwashing tablets, the prior art primarily deals with traditional high pH formulations systems and suggested routes to improving the performance of tablets rely on modifying solubility profiles in a fairly coarse manner.

Regarding inclusion of acidity to enhance anti-scaling benefits, it is known that an acid source can be used in machine dishwashing compositions to remove scale which results from the use of hard water. For example, vinegar is utilized to remove hardness scale and many current dishwashing machine cleaning products use an acid source to remove scale buildup. Many rinse aids for dishwashing also contain citric acid.

The use of a detergent composition with a pH of less than 9.5 for enhanced filming performance is disclosed in WO 95/12653, However, these systems do not deliver the benefits of higher pH washing along with the benefits of low pH for good filming. At the pH where filming is perceivably diminished in the wash, poor performance is obtained from both protease and many bleach systems. WO 95/12654 deals with a similar system with a limitation on the ratio of calcium complexing component to carbonate source of at least 0.8. However, the problem of achieving good anti-scaling benefits, which are optimum at low pH, and good cleaning performance, which is optimum at a significantly higher pH, is unresolved.

WO 95/12657 describes this issue and discusses the application of delaying release of an acid source for improved spotting and filming for use in machine dishwashing powder compositions. However, methods of delaying release of acidity, claiming both use of poorly soluble coatings and of modifying the physical characteristics of the acid to control its solubility and rate of release are not specifically addressed. In addition, there is no reference to use in tablets.

Thus, one object of the present invention is to utilize the unique characteristics of the tablet form to deliver both good bleaching from a oxygen bleach source, with or without a bleach catalyst, and good enzymatic protein soil removal along with good anti-scaling results by virtue of controlled release of a source of acidity. The specific release parameters for the source of acidity are primarily defined by the wash temperature.

Another object of the present invention is to provide tablets which are aesthetically pleasing and which are more consumer friendly by virtue of the virtual absence of fines on the tablet surface than tablets conventionally known in the art.

SUMMARY OF THE INVENTION

The present invention relates to solid dishwashing and warewashing compositions that have good handling characteristics and excellent cleaning performance by virtue of controlled release of the ingredients that allow the protease and bleach system to function at the initial part of the wash, where the wash pH is optimum for their cleaning action, and a source of acidity to be released later in the wash to deliver anti-scaling benefits.

The solid compositions are preferably in the form of tablets which have at least two layers. The first layer of a two layer tablet includes an oxygen bleach system, with or without an organic or inorganic bleach catalyst, from about 5 wt. % to about 90 wt. % of a builder, one or more enzymes and a buffering system. The oxygen bleach system can be a peracid, a peracid precursor and source of hydrogen peroxide, a source of hydrogen peroxide alone, a diacyl peroxide or mixtures thereof. Optionally, a surfactant, a processing aid to allow a high strength tablet to be processed under low compaction pressures, disintegrants to aid in tablet dissolution and lubricants to aid processing are present.

A second layer of a two-layer tablet includes of a source of acidity in a continuous medium that has a minimum melting point of about 35° C. and a maximum melting point of about 50° C. The source of acidity can be incorporated into the continuous medium either as is or in the form of a granulate. The granulate can optionally contain a surfactant to enhance dissolution.

The selection of buffer in the first layer of the tablet is such that when this layer dissolves, the wash pH lies between about 8.5 and about 11.0 and the level of acidity agent should be such that, after the second layer is released, the wash pH lies between about 6.5 and about 9.0.

This order of release allows for good functionality of the bleach and enzyme species during the initial part of the wash along with good anti-scaling properties. This is in contrast to systems that deliver all ingredients at high pH, where bleach and enzyme functionality is acceptable but scaling will be poor, or at low pH, where bleaching by the oxygen bleach system and protein soil removal by enzymes will be poor, but anti-scaling benefits will be good. The functional ingredients, other than the source of acidity to lower the pH, can be delivered from more than one layer to allow for improved stability of ingredients by separation of incompatible ingredients.

DETAILED DESCRIPTION OF THE PREFERRED EMBODIMENTS

The compositions of the invention may be in any conventional solid form useful in machine dishwashing and warewashing applications, but are preferably in the form of a tablet having at least two layers .

First Layer

The first layer of a two-layer tablet comprises from about 5 wt. % to about 90 wt. %, preferably about 10 wt. % to about 80 wt. %, most preferably about 15 wt. % to about 75 wt. % of a builder; an effective amount of at least one enzyme selected from the group consisting of a protease, an amylase and mixtures thereof, a buffering system to deliver a pH in the wash water of about 8.5 to about 11.0; an effective amount of an oxygen bleach system selected from the group consisting of a peracid, a peracid precursor plus a source of hydrogen peroxide, a source of hydrogen peroxide alone, a diacyl peroxide or mixtures thereof at a level of about 1 to about 25 wt. % with or without an organic or inorganic bleach catalyst which, if present, is at a level of about 0.0001 to about 10 wt. %, preferably about 0.001 to about 5 wt. % of the composition.

Detergent Builder Materials

The compositions of this invention can contain all manner of detergent builders commonly taught for use in machine dishwashing or other cleaning compositions. The builders can include any of the conventional inorganic and organic water-soluble builder salts, or mixtures thereof and may comprise about 5 to about 90 wt. %, and preferably, from about 10 to about 80 wt. % by weight of the cleaning composition.

Typical examples of phosphorus-containing inorganic builders, when present, include the water-soluble salts, especially alkali metal pyrophosphates, orthophosphates and polyphosphates. Specific examples of inorganic phosphate builders include sodium and potassium tripolyphosphates, pyrophosphates and hexametaphosphates.

Suitable examples of non-phosphorus-containing inorganic builders, when present, include water-soluble alkali metal carbonates, bicarbonates, sesquicarbonates, borates, silicates, including layered silicates such as SKS-6 ex. Hoechst, metasilicates, and crystalline and amorphous aluminosilicates. Specific examples include sodium carbonate (with or without calcite seeds), potassium carbonate, sodium and potassium bicarbonates, silicates including layered silicates and zeolites.

Organic detergent builders can also be used in the present invention. Examples of organic builders include alkali metal citrates, succinates, malonates, fatty acid sulfonates, fatty acid carboxylates, nitrilotriacetates, phytates, phosphonates, alkanehydroxyphosphonates, oxydisuccinates, alkyl and alkenyl disuccinates, oxydiacetates, carboxymethyloxy succinates, ethylenediamine tetraacetates, tartrate monosuccinates, tartrate disuccinates, tartrate monoacetates, tartrate diacetates, oxidized starches, oxidized heteropolymeric polysaccharides, polyhydroxysulfonates, polycarboxylates such as polyacrylates, polymaleates, polyacetates, polyhydroxyacrylates, polyacrylate/polymaleate and polyacrylate/polymethacrylate copolymers, acrylate/maleate/vinyl alcohol terpolymers, aminopolycarboxylates and polyacetal carboxylates, and polyaspartates and mixtures thereof. Such carboxylates are described in U.S. Pat. Nos. 4,144,226, 4,146,495 and 4,686,062.

Alkali metal citrates, nitrilotriacetates, oxydisuccinates, polyphosphonates, acrylate/maleate copolymers and acrylate/maleate/vinyl alcohol terpolymers are especially preferred organic builders.

The foregoing detergent builders are meant to illustrate but not limit the types of builders that can be employed in the present invention.

Enzymes

Enzymes capable of facilitating the removal of soils from a substrate may also be present in an amount of up to about 10% by wt. Such enzymes include proteases (e.g., Alcalase®, Savinase® and Esperase® from Novo Industries A/S and Purafect OxP, ex. Genencor), amylases (e.g., Termamyl® and Duramyl® from Novo Industries and Purafect OxAm, ex. Genencor).

Buffering System

The buffering system is present in the first layer to deliver a pH of about 8.5 to about 11 in the wash water. Materials which may be selected for the buffering system include water-soluble alkali metal carbonates, bicarbonates, sesquicarbonates, borates, silicates, layered silicates such as SKS-6 ex Hoechst, metasilicates, phytic acid, borate and crystalline and amorphous aluminosilicates and mixtures thereof. Preferred examples include sodium and potassium carbonate, sodium and potassium bicarbonates, borates and silicates, including layered silicates.

Oxygen Bleaching Systems

Peroxy Bleaching Agents

The oxygen bleaching agents of the compositions include organic peroxy acids and diacylperoxides. Typical monoperoxy acids useful herein include alkyl peroxy acids and aryl peroxy acids such as:

i) peroxybenzoic acid and ring-substituted peroxybenzoic acids, e.g., peroxy-alpha-naphthoic acid, and magnesium monoperoxyphthalate ii) aliphatic and substituted aliphatic monoperoxy acids, e.g., peroxylauric acid, peroxystearic acid, epsilon-phthallimido-peroxyhexanoic acid and o-carboxybenzamido peroxyhexanoic acid, N-nonyllamidoperadipic acid and N-nonylamidopersuccinic acid.

iii) Cationic peroxyacids such as those described in U.S. Pat. Nos. 5,422,028, 5,294,362; and 5,292,447, Atty. Docket No. 95-0394-UNI; Case 7392, Oakes et al.; and U.S. Ser. No. 08/210,973, Cakes et al., herein incorporated by reference.

iv) Sulfonyl peroxyacids such as compounds described in U.S. Pat. No. 5,039,447 (Monsanto Co.), herein incorporated by reference.

Typical diperoxy acids useful herein include alkyl diperoxy acids and aryl diperoxy acids, such as:

v) 1,12-diperoxydodecanedioic acid vi) 1,9-diperoxyazelaic acid vii) diperoxybrassylic acid; diperoxysecacic acid and diperoxy-isophthalic acid viii) 2-decyidiperoxybutan-1,4-dioic acid ix) N,N'-terephthaloyl-di(6-aminopercaproic acid).

A typical diacylperoxide useful herein includes dibenzoylperoxide.

Inorganic peroxygen compounds are also suitable for the present invention. Examples of these materials useful in the invention are salts of monopersulfate, perborate monohydrate, perborate tetrahydrate, and percarbonate.

Preferred oxygen bleaching agents include epsilon-phthalimido-peroxyhexanoic acid, o-carboxybenzamidoperoxyhexanoic acid, and mixtures thereof.

The organic peroxy acid is present in the composition in an amount such that the level of organic peroxy acid in the wash solution is about 1 ppm to about 300 ppm AvOx, preferably about 2 ppm to about 200 ppm AvOx.

The oxygen bleaching agent may be incorporated directly into the formulation or may be encapsulated by any number of encapsulation techniques.

A preferred encapsulation method is described in U.S. Pat. No. 5,200,236 issued to Lang et al., herein incorporated by reference. In the patented method, the bleaching agent is encapsulated as a core in a paraffin wax material having a melting point from about 40° C. to 50° C. The wax coating has a thickness of from 100 to 1500 microns.

Bleach Precursors

Suitable peracid precursors for peroxy bleach compounds have been amply described in the literature, including GB Nos. 836,988; 855,735; 907,356; 907;358; 907,950; 1,003,310 and 1,246,339; U.S. Pat. Nos. 3,332,882 and 4,128,494.

Typical examples of precursors are polyacylated alkylene diamines, such as N,N,N',N'-tetraacetylethylene diamine (TAED) and N,N,N',N'-tetraacetylmethylene diamine (TAMD); acylated glycolurils, such as tetraacetylglycoluril (TAGU); triacetylcyanurate, sodium sulfophenyl ethyl carbonic acid ester, sodium acetyloxybenene sulfonate (SABS), sodium nonanoyloxy benzene sulfonate (SNOBS) and choline sulfophenyl carbonate. Peroxybenzoic acid precursors are known in the art, e.g., as described in GB-A-836,988. Examples of suitable precursors are phenylbenzoate; phenyl p-nitrobenzoate; o-nitrophenyl benzoate; o-carboxyphenyl benzoate; p-bromophenylbenzoate; sodium or potassium benzoyloxy benzene-sulfonate; and benzoic anhydride.

Preferred peroxygen bleach precursors are sodium p-benzoyloxybenzene sulfonate, N,N,N',N'-tetraacetylethylene diamine, sodium nonanoyloxybenzene sulfonate and choline sulfophenyl carbonate.

The peroxygen bleach precursors are present in the composition in an amount from about 1 to about 20 weight percent, preferably from about 1 to about 15 wt. %, most preferably from about 2 to about 10 wt. %. To deliver a functional peroxygen bleach from a precursor, a source of hydrogen peroxide is required. The hydrogen peroxide source is preferably a compound that delivers hydrogen peroxide on dissolution. Preferred sources of hydrogen peroxide are sodium perborate, either as the mono- or tetrahydrate and sodium percarbonate. The source of hydrogen peroxide, when included in these compositions is present at a level of about 1% to about 30% by weight, preferably from about 2% to about 25% by weight, most preferably from about 4% to about 20% by weight.

Bleach Catalyst

An effective amount of a bleach catalyst can also be present in the first layer. A number of organic catalysts are available such as the sulfonimines as described in U.S. Pat. Nos. 5,041,232; 5,047,163 and 5,463,115.

Transition metal bleach catalysts are also useful especially those based on manganese, iron, cobalt, titanium, molybdenum, nickel, chromium, copper, ruthenium, tungsten and mixtures thereof. These include simple water-soluble salts such as those of iron, manganese and cobalt as well as catalysts containing complex ligands.

Suitable examples of manganese catalysts containing organic ligands are described in U.S. Pat. No. 4,728,455, U.S. Pat. No. 5,114,606, U.S. Pat. No. 5,153,161, U.S. Pat. No. 5,194,416, U.S. Pat. No. 5,227,084, U.S. Pat. No. 5,244,594, U.S. Pat. No. 5,246,612, U.S. Pat. No. 5,246,621, U.S. Pat. No. 5,256,779, U.S. Pat. No. 5,274,147, U.S. Pat. No. 5,280,117 and European Pat. App. Pub. Nos. 544,440, 544,490, 549,271 and 549,272. Preferred examples of these catalysts include $Mn^{IV}_2(\mu\text{-}O)_2$(1,4,7-trimethyl-1,4,7-triazacyclononane)$_2$(PF$_6$)$_2$, $Mn^{III}_2(\mu\text{-}O)_1(\mu\text{-}OAc)_2$(1,4,7-trimethyl-1,4,7-triazacyclononane)$_2$(ClO$_4$)$_2$, $Mn^{IV}_4(\mu\text{-}O)_6$(1,4,7-triazacyclononane)$_4$(ClO$_4$)$_4$, $Mn^{III}Mn^{IV}_4(\mu\text{-}O)_1(\mu\text{-}OAc)_2$(1,4,7-trimethyl-1,4,7triazacyclononane)$_2$(ClO$_4$)$_3$, $Mn^{IV}$(1,4,7-trimethyl-1,4,7-triazacyclononane)-(OCH$_3$)$_3$(PF$_6$), and mixtures thereof. Other metal-based bleach catalysts include those disclosed in U.S. Pat. No. 4,430,243 and U.S. Pat. No. 5,114,611. Iron and manganese salts of aminocarboxylic acids in general are useful herein including iron and manganese aminocarboxylate salts disclosed for bleaching in the photographic color processing arts. A particularly useful transition metal salt is derived from ethylenediaminedisuccinate and any complex of this ligand with iron or manganese.

Another type of bleach catalyst, as disclosed in U.S. Pat. No. 5,114,606 is a water soluble complex of manganese (II), (III), and/or (IV) with a ligand which is a non-carboxylate polyhydroxy compound having at least three consecutive C—OH groups. Preferred ligands include sorbitol, iditol, dulsitol, mannitol, xylithol, arabitol, adonitol, meso-erythritol, meso-inositol, lactose and mixtures thereof. Especially preferred is sorbitol.

U.S. Pat. No. 5,114,611 teaches a bleach catalyst comprising a complex of transition metals, including manganese, cobalt, iron or copper with a non-(macro)-cyclic ligand. Other examples include Mn gluconate, Mn(CF$_3$SO$_3$)$_2$, and binuclear Mn complexed with tetra-N-dentate and bi-N-Dentate ligands, including [bipy$_2$Mn$^{III}(\mu\text{-}O)_2$Mn$^{IV}$bipy$_2$]-(ClO$_4$)$_3$.

Other bleach catalysts are described, for example, in European Pat. App. Pub. Nos. 408,131 (cobalt complexes), 384,503 and 306,089 (metallo-porphyrins), U.S. Pat. No. 4,728,455 (manganese/multidenate ligand), U.S. Pat. No. 4,711,748 (absorbed manganese on aluminosilicate), U.S. Pat. No. 4,601,845 (aluminosilicate support with manganese, zinc or magnesium salt), U.S. Pat. No. 4,626,373 (manganese/ligand), U.S. Pat. No. 4,119,557 (ferric complex), U.S. Pat. No. 4,430,243 (Chelants with manganese cations and non-catalytic metal cations), and U.S. Pat. No. 4,728,455 (manganese gluconates).

Useful catalysts based on cobalt are described in Pat. App. Pub. Nos. WO 96/23859, WO 96/23860 and WO 96/23861 and U.S. Pat. No. 5,559,261. WO 96/23860 describe cobalt catalysts of the type $[Co_nL_mX_p]^zY_z$, where L is an organic ligand molecule containing more than one heteroatom selected from N, P, O and S; X is a co-ordinating species; n is preferably 1 or 2; m is preferably 1 to 5; p is preferably 0 to 4 and Y is a counterion. One example of such a catalyst is N,N'-Bis(salicylidene)ethylenediaminecobalt (II). Other cobalt catalysts described in these applications are based on Co(III) complexes with ammonia and mon-, bi-, tri- and tetradentate ligands such as $[Co(NH_3)_5OAc]^{2+}$ with $Cl^-$, $OAc^-$, $PF_6^-$, $SO_4^=$, $BF_4^-$ anions.

Certain transition-metal containing bleach catalysts can be prepared in the situ by the reaction of a transition-metal salt with suitable chelating agent, for example, a mixture of manganese sulfate and ethylenediaminedisuccinate. Highly colored transition metal-containing bleach catalysts may be co-processed with zeolites to reduce the color impact.

When present, the bleach catalyst is typically incorporated at a level of about 0.0001 to about 10% by wt., preferably about 0.001 to about 5% by weight.

Optional First Layer Ingredients

Optionally a surfactant may be included in the first layer including anionic, nonionic, cationic, amphoteric, zwitterionic surfactants and mixtures of these surface active agents. Such surfactants are well known in the detergent arts and are described at length at "Surface Active Agents and Detergents", Vol. 2 by Schwartz, Perry and Birch, Interscience Publishers, Inc., 1959, herein incorporated by reference.

Preferred surfactants are one or a mixture of:

Anionic surfactants

Anionic synthetic detergents can be broadly described as surface active compounds with one or more negatively charged functional groups. An important class of anionic compounds are the water-soluble salts, particularly the alkali metal salts, of organic sulfur reaction products having in their molecular structure an alkyl radical containing from about 6 to 24 carbon atoms and a radical selected from the group consisting of sulfonic and sulfuric acid ester radicals.

Primary Alkyl Sulfates $$R^1OSO_3M$$

where $R^1$ is a primary alkyl group of 8 to 18 carbon atoms and M is a solubilizing cation. The alkyl group $R^1$ may have a mixture of chain lengths. It is preferred that at least two thirds of the $R^1$ alkyl groups have a chain length of 8 to 14 carbon atoms. This will be the case if $R^1$ is coconut alkyd, for example. The solubilizing cation may be a range of cations which are in general monovalent and confer water solubility. Alkali metal, notably sodium, is especially envisaged. Other possibilities are ammonium and substituted ammonium ions, such as trialkanolammonium or trialkylammonium.

Alkyl Ether Sulfates $$R^1O(CH_2CH_2O)_nSO_3M$$

where $R^1$ is a primary alkyl group of 8 to 18 carbon atoms, n has an average value in the range from 1 to 6 and M is a solubilizing cation. The alkyl group $R^1$ may have a mixture of chain lengths. It is preferred that at least two thirds of the $R^1$ alkyl groups have a chain length of 8 to 14 carbon atoms. This will be the case if $R^1$ is coconut alkyl, for example. Preferably n has an average value of 2 to 5.

Fatty Acid Ester Sulfonates $$R^2CH(SO_3M)CO_2R^3$$

where $R^2$ is an alkyl group of 6 to 16 atoms, $R^3$ is an alkyl group of 1 to 4 carbon atoms and M is a solubilizing cation. The group $R^2$ may have a mixture of chain lengths. Preferably at least two thirds of these groups have 6 to 12 carbon atoms. This will be the case when the moiety $R^2CH(-)CO_2(-)$ is derived from a coconut source, for instance. It is preferred that $R^3$ is a straight chain alkyl, notably methyl or ethyl.

Alkyl Benzene Sulfonates $$R^4ArSO_3M$$

where $R^4$ is an alkyl group of 8 to 18 carbon atoms, Ar is a benzene ring ($C_6H_4$) and M is a solubilizing cation. The group $R^4$ may be a mixture of chain lengths. Straight chains of 11 to 14 carbon atoms are preferred.

Paraffin sulfonates having 8 to 22 carbon atoms, preferably 12 to 16 carbon atoms, in the alkyl moiety. These surfactants are commercially available as Hostapur SAS from Hoechst Celanese.

Olefin sulfonates having 8 to 22 carbon atoms, preferably 12 to 16 carbon atoms. U.S. Pat. No. 3,332,880 contains a description of suitable olefin sulfonates.

Organic phosphate based anionic surfactants include organic phosphate esters such as complex mono- or diester phosphates of hydroxyl-terminated alkoxide condensates, or salts thereof. Included in the organic phosphate esters are phosphate ester derivatives of polyoxyalkylated alkylaryl phosphate esters, of ethoxylated linear alcohols and ethoxylates of phenol. Also included are nonionic alkoxylates having a sodium alkylenecarboxylate moiety linked to a terminal hydroxyl group of the nonionic through an ether bond. Counterions to the salts of all the foregoing may be those of alkali metal, alkaline earth metal, ammonium, alkanolammonium and alkylammonium types.

Particularly preferred anionic surfactants are the fatty acid ester sulfonates with formula:

$$R^2CH(SO_3M)CO_2R^3$$

where the moiety $R^2CH(-)CO_2(-)$ is derived from a coconut source and $R^3$ is either methyl or ethyl; primary alkyl sulfates with the formula:

$$R^1OSO_3M$$

wherein $R^1$ is a primary alkyl group of 10 to 18 carbon atoms and M is a sodium cation; and paraffin sulfonates, preferably with 12 to 16 carbon atoms to the alkyl moiety.

Nonionic surfactants

Nonionic surfactants can be broadly defined as surface active compounds with one or more uncharged hydrophilic substituents. A major class of nonionic surfactants are those compounds produced by the condensation of alkylene oxide groups with an organic hydrophobic material which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Illustrative, but not limiting examples, of various suitable nonionic surfactant types are: polyoxyalkene condensates of aliphatic carboxylic acids, whether linear- or branched-chain and unsaturated or saturated, especially ethoxylated and/or propoxylated aliphatic acids containing from about 8 to about 18 carbon atoms in the aliphatic chain and incorporating from about 2 to about 50 ethylene oxide and/or propylene oxide units. Suitable carboxylic acids include "coconut" fatty acids (derived from coconut oil) which contain an average of about 12 carbon atoms, "tallow" fatty acids (derived from tallow-class fats) which contain an average of about 18 carbon atoms, palmitic acid, myristic acid, stearic acid and lauric acid, polyoxyalkene condensates of aliphatic alcohols, whether linear- or branched-chain and unsaturated or saturated, especially ethoxylated and/or propoxylated aliphatic alcohols containing from about 6 to about 24 carbon atoms and incorporating from about 2 to about 50 ethylene oxide and/or propylene oxide units. Suitable alcohols include "coconut" fatty alcohol, "tallow" fatty alcohol, lauryl alcohol, myristyl alcohol and oleyl alcohol.

Ethoxylated fatty alcohols may be used alone or in admixture with anionic surfactants, especially the preferred surfactants above. The average chain lengths of the alkyl group $R^5$ in the general formula:

$$R^5O(CH_2CH_2O)_nH$$

is from 6 to 20 carbon atoms. Notably the group $R^5$ may have chain lengths in a range from 9 to 18 carbon atoms.

The average value of n should be at least 2. The numbers of ethylene oxide residues may be a statistical distribution around the average value. However, as is known, the distribution can be affected by the manufacturing process or altered by fractionation after ethoxylation. Particularly preferred ethoxylated fatty alcohols have a group $R^5$ which has 9 to 18 carbon atoms while n is from 2 to 8.

Also included within this category are nonionic surfactants having a formula:

$$R^6-(\underset{\underset{R^7}{|}}{CH_2CHO})_x(CH_2CH_2O)_y(\underset{\underset{R^8}{|}}{CH_2CHO})_zH$$

wherein $R^6$ is a linear alkyl hydrocarbon radical having an average of 6 to 18 carbon atoms, $R^7$ and $R^8$ are each linear alkyl hydrocarbons of about 1 to about 4 carbon atoms, x is an integer of from 1 to 6, y is an integer of from 4 to 20 and z is an integer from 4 to 25.

One preferred nonionic surfactant of the above formula is Poly-Tergent SLF-18® a registered trademark of the Olin Corporation, New Haven, Conn. having a composition of the above formula where $R^6$ is a $C_6$–$C_{10}$ linear alkyl mixture, $R^7$ and $R^8$ are methyl, x averages 3, y averages 12 and z averages 16. Another preferred nonionic surfactant is $$R^9O(\underset{\underset{CH_3}{|}}{CH_2CHO})_j(CH_2CH_2O)_k(CH_2CH(OH)R^{10})_l$$

wherein $R^9$ is a linear, aliphatic hydrocarbon radical having from about 4 to about 18 carbon atoms including mixtures thereof; and $R^{10}$ is a linear, aliphatic hydrocarbon radical having from about 2 to about 26 carbon atoms including mixtures thereof; j is an integer having a value of from 1 to about 3; k is an integer having a value from 5 to about 30; and z is an integer having a value of from 1 to about 3. Most preferred are compositions in which j is 1, k is from about 10 to about 20 and l is 1. These surfactants are described in WO 94/22800. Other preferred nonionic surfactants are linear fatty alcohol alkoxylates with a capped terminal group, as described in U.S. Pat. No. 4,340,766 to BASF. Particularly preferred is Plurafac LF403 ex. BASF.

Another nonionic surfactant included within this category are compounds of formula:

$$R^{11}-(CH_2CH_2O)_qH$$

wherein $R^{11}$ is a $C_6$–$C_{24}$ linear or branched alkyl hydrocarbon radical and q is a number from 2 to 50; more preferably $R^{11}$ is a $C_8$–$C_{18}$ linear alkyl mixture and q is a number from 2 to 15.

polyoxyethylene or polyoxypropylene condensates of alkyl phenols, whether linear- or branched-chain and unsaturated or saturated, containing from about 6 to 12 carbon atoms and incorporating from about 2 to about 25 moles of ethylene oxide and/or propylene oxide.

polyoxyethylene derivatives of sorbitan mono-, di-, and tri-fatty acid esters wherein the fatty acid component has between 12 and 24 carbon atoms. The preferred polyoxyethylene derivatives are of sorbitan monolaurate, sorbitan trilaurate, sorbitan monopalmitate, sorbitan tripalmitate, sorbitan monostearate, sorbitan monoisostearate, sorbitan tripalmitate, sorbital tristearate, sorbitan monooleate, and sorbitan trioleate. The polyoxyethylene chains may contain between about 4 and 30 ethylene oxide units, preferably about 10 to 20. The sorbitan ester derivatives contain 1, 2 or 3 polyoxyethylene chains dependent upon whether they are mono-, di- or tri-acid esters.

polyoxyethylene-polyoxypropylene block copolymers having formula:

$$HO(CH_2CH_2O)_a(CH(CH_3)CH_2O)_b(CH_2CH_2O)_cH$$

or $$HO(CH(CH_3)CH_2O)_d(CH_2CH_2O)_e(CH(CH_3)CH_2O)_fH$$

wherein a, b, c, d, e and f are integers from 1 to 350 reflecting the respective polyethylene oxide and polypropylene oxide blocks of said polymer. The polyoxyethylene component of the block polymer constitutes at least about 10% of the block polymer. The material preferably has a molecular weight of between about 1,000 and 15,000, more preferably from about 1,500 to about 6,000. These materials are well-known in the art. They are available under the trademark "Pluronic" and "Pluronic R", a product of BASF Corporation.

Amine oxides having formula:

$$R^{12}R^{13}R^{14}N{=}O$$

wherein $R^{12}$, $R^{13}$ and $R^{14}$ are saturated aliphatic radicals or substituted saturated aliphatic radicals. Preferable amine oxides are those wherein $R^{12}$ is an alkyl chain of about 10 to about 20 carbon atoms and $R^{13}$ and $R^{14}$ are methyl or ethyl groups or both $R^{12}$ and $R^{13}$ are alkyl chains of about 6 to about 14 carbon atoms and $R^{14}$ is a methyl or ethyl group.

Amphoteric synthetic detergents can be broadly described as derivatives of aliphatic tertiary amines, in which the aliphatic radical may be straight chain or branched and wherein one of the aliphatic substituents contain from about 8 to about 18 carbons and one contains an anionic water-solubilizing group, i.e., carboxy, sulpho, sulphato, phosphato or phosphono. Examples of compounds falling within this definition are sodium 3-dodecylamino propionate and sodium 2-dodecylamino propane sulfonate.

Zwitterionic synthetic detergents can be broadly described as derivatives of aliphatic quaternary ammonium, phosphonium and sulphonium compounds in which the aliphatic radical may be straight chained or branched, and wherein one of the aliphatic substituents contains from about 8 to about 18 carbon atoms and one contains an anionic water-solubilizing group, e.g., carboxy, sulpho, sulphato, phosphato or phosphono. These compounds are frequently referred to as betaines. Besides alkyl betaines, alkyl amino and alkyl amido betaines are encompassed within this invention.

Alkyl Glycosides $$R^{15}O(R^{16}O)_n(Z^1)_p$$

wherein $R^{15}$ is a monovalent organic radical (e.g., a monovalent saturated aliphatic, unsaturated aliphatic or aromatic radical such as alkyl, hydroxyalkyl, alkenyl, hydroxyalkenyl, aryl, alkylaryl, hydroxyalkylaryl, arylalkyl, alkenylaryl, arylalkenyl, etc.) containing from about 6 to about 30 (preferably from about 8 to 18 and more preferably from about 9 to about 13) carbon atoms; $R^{16}$ is a divalent hydrocarbon radical containing from 2 to about 4 carbon atoms such as ethylene, propylene or butylene (most preferably the unit $(R^{16}O)_n$ represents repeating units of ethylene oxide, propylene oxide and/or random or block combinations thereof); n is a number having an average value of from 0 to about 12; $Z^1$ represents a moiety derived from a reducing saccharide containing 5 or 6 carbon atoms (most preferably a glucose unit); and p is a number having an average value of from 0.5 to about 10 preferably from about 0.5 to about 5 .

Examples of commercially available materials from Henkel Kommanditgesellschaft Aktien of Dusseldorf, Germany include APG® 300, 325 and 350 with $R^{15}$ being $C_9$–$C_{11}$, n is 0 and p is 1.3, 1.6 and 1.8–2.2 respectively; APG® 500 and 550 with $R^{15}$ is $C_{12}$–$C_{13}$, n is 0 and p is 1.3 and 1.8–2.2, respectively; and APG® 600 with $R^{15}$ being $C_{12}$–$C_{14}$, n is 0 and p is 1.3.

While esters of glucose are contemplated especially, it is envisaged that corresponding materials based on other reducing sugars, such as galactose and mannose are also suitable.

Particularly preferred nonionic surfactants are polyoxyethylene and polyoxypropylene condensates of linear aliphatic alcohols.

The preferred range of surfactant is from about 0.5 to 30% by wt., more preferably from about 0.5 to 15% by wt of the composition.

Sequestrants

The detergent compositions herein may also optionally contain one or more transition metal chelating agents. Such chelating agents can be selected from the group consisting of amino carboxylates, amino phosphonates, polyfunctionally-substituted aromatic chelating agents and mixtures therein. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetraacetates, N-hydroxyethylethylenediaminetriacetates, nitrilotriacetates, ethylenediamine tetraproprionates, triethylenetetraamine-hexaacetates, diethylenetriaminepentaacetates, ethylenediamine disuccinate, and ethanoldiglycines, alkali metal, ammonium, and substituted ammonium salts therein and mixtures therein.

Amino phosphonates are also suitable for use as chelating agents in the compositions of the invention when at least low levels of total phosphorus are permitted in detergent compositions, and include ethylenediaminetetrakis (methylenephosphonates), nitrilotris (methylenephosphonates) and diethylenetriaminepentakis (methylenephosphonates). Preferably, these amino phosphonates do not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

If utilized, these chelating agents will generally comprise from about 0.1% to about 10% by weight of the detergent compositions herein. More preferably, if utilized, the chelating agents will comprise from about 0.1% to about 3.0% by weight of such composition.

Anti-Scalants

Scale formation on dishes and machine parts can be a significant problem. It can arise from a number of sources but, primarily it results from precipitation of either alkali earth metal carbonate, phosphates and silicates. Calcium carbonate and phosphates are the most significant problem. To reduce this problem, ingredients to minimise scale formation can be incorporated into the composition. These include polyacrylates of molecular weight from 1,000 to 400,000 examples of which are supplied by Rohm & Haas, BASF and Alco Corp. and polymers based on acrylic acid combined with other moieties. These include acrylic acid combined with maleic acid, such as Sokalan® CP5 supplied by BASF or Acusol® 479N supplied by Rohm & Haas; with vinyl pyrrolidone such as Acrylidone® supplied by ISP; with methacrylic acid such as Colloid® 226/35 supplied by Rhone-Poulenc; with phosphonate such as Casi® 773 supplied by Buckman Laboratories; with maleic acid and vinyl acetate such as polymers supplied by Huls; with acrylamide; with sulfophenyl methallyl ether such as Aquatreat® AR 540 supplied by Alco; with 2-acrylamido-2-methylpropane sulfonic acid such as Acumer® 3100 supplied by Rohm & Haas; with sulfonic acid such as K-775 supplied by Goodrich; with sulfonic acid and sodium styrene sulfonate such as K-798 supplied by Goodrich; with methyl methacrylic acid, sodium methallyl sulfonate and sulfophenyl methallyl ether such as Alcoperse® 240 supplied by Alco; polymaleates such as Belclene® 200 supplied by FMC; polymethacrylates such as Tamol® 850 from Rohm & Haas; polyaspartates; ethylenediamine disuccinate; organo polyphosphonic acids and their salts such as the sodium salts of aminotri(methylenephosphonicacid) and ethane 1-hydroxy-1,1-diphosphonicacid. The anti-scalant, if present, is included in the composition from about 0.05% to about 10% by weight, preferably from 0.1% to about 5% by weight, most preferably from about 0.2% to about 5% by weight.

Tablet Additives

Tablets frequently require adjuncts, called excipients. These have many uses, for example, in binding the ingredients together in the tablet, in aiding disintegration of the tablet in the wash and to facilitate manufacture of the tablet. The key ingredients in this category are binders, disintegrants and lubricants. One important property of these tablet additives is that they be compatible with the active ingredients in the tablet. Often, a binder also performs the role of disintegrant and it is useful to consider these two functions together.

The purpose of the binder/disintegrant is to help hold the ingredients of the tablet together but still allow dissolution in the wash water. With certain ingredients, a binder is essential to allow formation of a tablet but, even when a tablet can be formed in the absence of the binder, incorporation of a binder allows use of lower compaction pressures which aids in the breakdown of the tablet in the wash liquor. Lower compaction pressures allow for higher throughput during processing of tablets while decreasing the probability of mechanical breakdown of parts due to high stress.

A number of binders and disintegrants are described in the literature (see, for example, "Pharmaceutical Dosage Forms: Volume 1", 1989, Marcel Dekker Inc., ISBN 0-8247-8044-2). Both natural polymeric materials and synthetic polymers are useful. These include starches, such as corn, maize, rice and potato starches and starch derivatives such as U-Sperse M® and U-Sperse® supplied by National Starch, Primojel® carboxymethyl starch and sodium starch glycolate such as Explotab®, pregelatinized corn starches such as National® 1551 and Starch® 1500; celluloses and cellulose derivatives including sodium carboxymethyl cellulose such as Courlose® and Nymcel®, cross-linked sodium carboxymethyl cellulose such as Ac-Di-Sol® supplied by FMC Corp., microcrystalline cellulosic fibers such as Hanfloc®, microcrystalline cellulose such as Lattice® NT supplied by FMC Corp. and Avicel® PH supplied by FMC Corp. methylcellulose, ethylcellulose, hydroxypropylcellulose and hydroxypropylmethylcellulose. Other polymers useful as binders/disintegrants are polyvinylpyrrolidones such as Plasdone®, PVP® K-30 and PVP® K-60 all supplied by International Specialty Products; polyvinylpolypyrrolidones, a cross-linked homopolymer of N-vinyl-2-pyrrolidone such as Polyplasdone® XL supplied by international Specialty Products; polymethacrylates, polyvinyl alcohols and polyethylene glycols. Gums such as acacia, tragacanth, guar, locust bean and pectin, gelatin, sucrose and alginates are also useful as binders/disintegrants. Suitable inorganic materials include magnesium aluminum silicate such as Veegum® HV supplied by R. T. Vanderbilt Co. Inc., bentonite and montmorillonite such as Gelwhite® supplied by Southern Clay Products. Other suitable binders include monoglycerides such as Imwitor® 191 supplied by Huls America Inc., glyceryl stearates such as Imwitor 900® supplied by Huls America Inc., and palm oil glycerides such as Inwitor® 940 supplied by Huls America Inc. Most preferred as binders/disintegrants are microcrystalline celluloses and polyethylene glycols. Preferred polyethylene glycols have molecular weights from about 2,000 to about 15,000.

Another way of enhancing dissolution of a tablet in the wash water is to incorporate an effervescent system. This includes weak acids or acid salts such as citric acid, maleic acid, tartaric acid, sodium hydrogen phosphates, in combination with a basic ingredient that evolves carbon dioxide when interacting with this acid source. Examples include sodium and potassium carbonate and bicarbonate and sodium sesquicarbonate.

Other tablet additives commonly used are lubricants to aid the tabletting process, such as stearates, waxes, hydrogenated vegetable oils and polyethylene glycols and fillers such as sugars, sodium sulfate and sodium chloride.

Minor amounts of various other components may be present in the first layer of the tablet. These components include bleach scavengers including but not limited to sodium bisulfite, sodium perborate, reducing sugars, and short chain alcohols; enzyme stabilizing agents; soil suspending agents; antiredeposition agents; anti-corrosion agents, such as benzotriazole and its derivatives, isocyanuric acid described in Angevaare, U.S. Pat. No. 5,374,369; purine derivatives described in Angevaare, U.S. Pat. No. 5,468,410; 1,3-N azole compounds described in Gary, U.S. Pat. No. 5,480,576; ingredients to enhance decor care such as certain aluminum salts described in U.S. Pat. Nos. 5,698,506 and 5,624,892, colorants; perfumes; defoamers such as mono- and distearyl phosphate silicone oil, mineral oil and those described in Angevaare et al., U.S. Pat. No. 5,705,465 and other functional additives. All publications herein incorporated by reference.

Optionally the functional ingredients described above included in the first layer of a two layer tablet may also be delivered from multiple layers to enhance performance by controlling the release of the ingredients or to improve storage stability of mutually incompatible ingredients.

Second Tablet Layer

A second tablet layer of a two layer tablet comprises a continuous medium that has a minimum melting point of about 35° C. and a maximum melting point of about 50° C. and a solids content of 0% to about 10% at 60° C. and acts as a carrier for a source of acidity and optionally, a surfactant, releasing these ingredients at the appropriate time during the wash cycle.

Materials of the Continuous Medium

Materials suitable for use as the continuous medium of the last layer of the tablet must have a number of characteristics. Thus, the material must be chemically compatible with ingredients to be incorporated into the layer, must be compressible into a tablet layer and must have a suitable release profile, especially an appropriate melting point range. The preferred melting point range is from about 35° C. to about 50° C. with the materials having a solids content of 0% to about 10% at 60° C. Paraffin waxes, microcrystalline waxes and natural waxes give good results. Some preferred paraffin waxes, all of which have 0% solids content at 60° C., include Merck® 7150 and Merck® 7151 supplied by E. Merck of Darmstadt, Germany; Boler® 1397, Boler® 1538 and Boler® 1092 supplied by Boler of Wayne, Pa.; Ross® fully refined paraffin wax 115/120 supplied by Frank D. Ross Co., Inc of Jersey City, N.J.; Tholler® 1397and Tholler® 1538 supplied by Tholler of Wayne, Pa.; Paramelt® 4608 supplied by Terhell Paraffin of Hamburg, Germany and Paraffin® R7214 supplied by Moore & Munger of Shelton, Conn.

Natural waxes, such as natural bayberry wax, m.pt. 42–48 supplied by Frank D. Ross Co., Inc, are also useful as are synthetic substitutes of natural waxes such as synthetic spermaceti wax, m.pt. 42–50, supplied by Frank ID. Ross Co., Inc., synthetic beeswax (BD4) and glyceryl behenate (HRC) synthetic wax.

Polyvinyl ether is useful as a material of the continuous medium. The molecular formula is [CxH2xO]y wherein x is 18–22 and y is 150–300, preferably x is 18–22 and y is 150–280, most preferably x is 20 and y is 150–250. The melting point range is from about 40 C to about 50 C. A preferred polyvinyl ether material is supplied by BASF under the Luwax® V series. Polyvinyl ether is especially useful when mixed with a wax of a suitable melting point range.

Other options for the material of the continuous medium are fatty acids such as lauric acid and fatty acid derivatives such as the alkonamides and glyceryl esters, mono-, di- and triglycerides, alkali metal salts of fatty acids and fatty alkyl phosphate esters. Lime soap dispersants and antifoaming agents may be required if fatty acids or their derivatives are used for the continuous medium. Mixtures of fatty acids that have the appropriate melting point range are also acceptable. Polyethylene waxes of suitable melting point are also useful, especially when mixed with suitable waxes.

Other potential materials for use as the continuous medium are solid surfactants, especially nonionic surfactants. Incorporation of an anti-foaming agent is likely to be required with use of surfactant. Surfactants useful in this invention are listed under "Surfactants" above. Examples are polyoxyalkene condensates of aliphatic acids, alcohols and phenols, polyoxyalkalene block copolymers and block copolymers derived from addition of propylene oxide and ethylene oxide to ethylenediamine. Other suitable materials are sorbitan esters, polyoxyethylene sorbitan fatty acid esters, polyethylene glycols, polyvinyl alcohols, ethylene-vinylacetate, styrene-vinylacetate and ethylene-maleic anhydride copolymers and partially esterified polymers of maleic anhydride, acrylic acid or methacrylic acid.

Most preferred are paraffin waxes either alone or as a mixture with polyvinyl ethers.

Sources of Acidity

The amount of acidity agent present in the second layer is dependent on the amount and the source of the buffering system in the first layer. The amount of acidity incorporated should be such that the pH of the wash water after release of the acidity should be below about pH 9, preferably below about pH 8.5 and most preferably below about pH 8. The acidity agent may thus be present in an amount of up to 50 wt. %, preferably 1 to 40 wt. %. The source of acidity can be added directly, as is, to the continuous medium of the second layer or be granulated with a binder and optionally with a surfactant for rapid dissolution prior to mixing with the continuous medium. The acidity granules should be between 100 and 2,000 microns and size. An alternative method of incorporating the acidity source is to coat the acidity granule with the continuous medium of the second layer in, for instance, a fluid bed, pan coater or rolling drum to produce encapsulates which may be directly used to form the second layer. Particularly preferred methods of producing the encapsulates optionally with a surfactant for the rapid dissolution are described in Nicholson, U.S. Pat. No. 5,480,577 herein incorporated by reference.

A range of acidity sources are suitable for the invention. It is preferable that the source of acidity be solid at room temperature. Mono-, di- and polycarboxylates are especially useful sources of acidity including lactic acid, glycolic acid, adipic acid, fumaric acid, malleic acid, malic acid, succinic acid, tartaric acid, malonic acid, tartronic acid, glutaric acid, gluconic acid, ascorbic acid and citric acid. Preferred inorganic sources of acidity include boric acid and the alkali metal and alkali earth metal salts of bicarbonate, hydrogen sulfate and hydrogen phosphate. Organo phospoic acids, such as 1-hydroxyethane 1,1-diphosphonic acid or amino polymethylene phosphonic acids, are also useful. Most preferred is citric acid.

Inclusion of surfactant into the second layer is desirable to ensure good dispersion of the continuous medium of the second layer into the wash water. Preferred surfactants are nonionics produced by the condensation of alkylene oxide groups with an organic hydrophobic material which may be aliphatic or alkyl aromatic in nature. Especially preferred surfactants are described in WO 94/22800 of which those that have a melting point above 20° C. are most preferred.

Processing of Tablets

For a two-layer tablet, the ingredients of the first layer are admixed, transferred to the tablet die and compressed with a compaction pressure from about of $5\times10^6$ kg/m$^2$ to about $3\times10^7$ kg/m$^2$. Processing of the second layer can proceed via a number of routes.

The materials of the continuous medium of the second layer are frequently most conveniently available in a solid form and thus are best handled by making flakes of this material and mixing these flakes with the acidic moiety. This whole mixture is then transferred to the die on top of the first layer and compressed with a compaction pressure of from about $1\times10^6$ kg/m$^2$ to about $3\times10^7$ kg/m$^2$. A preferred route is to pre-granulate the source of acidity, optionally with surfactant to enhance dissolution, to give granulates of size 100–2000 microns and mix these together with the material of the continuous layer prior to compaction. Another way of creating the second layer is to pre-coat the granulate containing the source of acidity with the continuous medium via, for example, a fluid bed, pan coater or rolling drum to give encapsulates. The encapsulates are compressed with a compaction pressure from about $1\times10^6$ kg/m$^2$ to about $3\times10^7$ kg/m$^2$ to give a second layer with discrete capsules of source of acidity.

It is advisable to also add surfactant separately into the second layer to ensure good dispersion of the material of the continuous medium of the second layer into the wash water. This is best achieved by pre-mixing a surfactant that is solid at room temperature with the materials at the continuous medium of the layer prior to compaction.

The same process is utilized for multi-layer tablets except that the ingredients of all but the last layer are sequentially compacted within their respective layers.

The following examples will serve to distinguish this invention from the prior art and illustrate its embodiment more fully. Unless otherwise indicated, all parts, percentages and proportions referred to are by weights.

EXAMPLE 1

Tablets (34 mm diameter, 14–18 mm thickness) were prepared according to the compositions shown in Table 1. The bleaching system contains a hydrogen peroxide source and a manganese catalyst. All values are in grams per ingredient and, unless specified, all anionic species are the sodium salts. The tablets were processed according to the specifications above with citric acid as a source of acidity mixed with flakes of a paraffin wax prior to tabletting. Tablets C and D lie within the scope of this invention and Tablets A and B lie outside.

TABLE 1

| | A | B | C | | D | |
|---|---|---|---|---|---|---|
| Component | Layer 1 | Layer 1 | Layer 1 | Layer 2 | Layer 1 | Layer 2 |
| Citrate | 7.0 | 7.0 | 7.0 | | 7.0 | |
| Sokalan ® CP 5[1] | 0.7 | 0.7 | 0.7 | | 0.7 | |
| Disilicate | 3.8 | 3.8 | 3.8 | | 3.8 | |
| Sokalan ® PA 25[2] | 0.35 | 0.35 | 0.35 | | 0.35 | |
| Carbonate | 1.25 | 1.25 | 1.25 | | 1.25 | |
| Mn Catalyst[3] | 0.45 | 0.45 | 0.45 | | 0.45 | |
| Perborate Monohydrate | 3.25 | 3.25 | 3.25 | | 3.25 | |
| Protease[4] | 0.60 | 0.60 | 0.60 | | 0.60 | |
| Amylase[5] | 0.35 | 0.35 | 0.35 | | 0.35 | |
| Plurafac ® LF 403[6] | | 0.20 | | | 0.20 | |
| Citric Acid | | | | 4.0 | | 4.0 |
| Wax[7] | | | | 2.0 | | 2.0 |

[1]Acrylate/maleate copolymer ex. BASF
[2]Polyacrylate ex BASF
[3]As described in U.S. PAT. NO. 5,246,621.
[4]Savinase ® 6T ex Novo
[5]Termamyl ® 60T ex Novo
[6]Surfactant ex. BASF
[7]Boler ® 1397, m.pt. 42–46° C.

The tablets were evaluated in the E50 cycle of a Bosch dishwashing machine. The tablets were introduced into the machine via a basket hanging from the top rack. Glass tumblers were evaluated for filming using the visual scoring system where filming is rated from 0 (no film) to 5 (heavy film). The permanent wash water hardness was 300 ppm (4:1 calcium/magnesium expressed as calcium carbonate) and the temporary wash water hardness (bicarbonate) was 320 ppm. The glasses were washed up to 10 cycles.

For Tablets A and B, the pH throughout the main wash was 9.7 to 9.9. For Tablets C and D, the pH of the wash water was 9.3 to 9.6 after 5 minutes of the main wash and 8.3 to 8.6 after 10 minutes of the main wash.

The results are summarized in Table 2.

TABLE 2

| | Filming on Glasses | | | | |
|---|---|---|---|---|---|
| Tablet | Run #2 | Run #4 | Run #6 | Run #8 | Run #10 |
| A | 2.0 | 2.0 | 2.2 | 2.1 | 2.5 |
| B | 1.6 | 1.9 | 2.0 | 2.5 | 3.0 |

TABLE 2-continued

| | Filming on Glasses | | | | |
|---|---|---|---|---|---|
| Tablet | Run #2 | Run #4 | Run #6 | Run #8 | Run #10 |
| C | 1.5 | 1.5 | 1.5 | 1.5 | 1.6 |
| D | 1.2 | 1.6 | 1.6 | 1.8 | 2.0 |

The advantage of the technology of the current invention to maintain low scaling is clear. For tablets A and B, which are outside the scope of this invention, there is no controlled release of acidity source. Thus, in Tablets A and B, the pH is maintained above pH 9.5 throughout the wash which is not beneficial for prevention of scaling. In Tablets C and D, which lie within the scope of this invention, controlled release of an acidity source allows for a high initial wash pH, which is traditionally beneficial for bleaching and soil removal, and a controlled drop in wash pH for good glass appearance by virtue of reduced scaling. This benefit is observed both in the presence and absence of surfactant.

EXAMPLE 2

Tablets (34 mm diameter, 14–18 mm thickness) were prepared according to the compositions shown in Table 3. The bleaching system contains a source of hydrogen peroxide and TAED as the peracid precursor. All values are in grams per ingredient and, unless specified, all anionic species are the sodium salts. The tablets were processed according to the specifications above with citric acid as a source of acidity mixed with flakes of a paraffin wax prior to tabletting. Tablet F lies within the scope of this invention and Tablet E lies outside.

TABLE 3

| | E | F | |
|---|---|---|---|
| Component | Layer 1 | Layer 1 | Layer 2 |
| Citrate | 7.0 | 7.0 | |
| Sokalan ® CP 5[1] | 0.7 | 0.7 | |
| Disilicate | 3.8 | 3.8 | |
| Sokalan ® PA 25[2] | 0.35 | 0.35 | |
| Carbonate | 1.25 | 1.25 | |
| TAED[3] | 0.60 | 0.60 | |
| Perborate Monohydrate | 2.25 | 2.25 | |
| Protease[4] | 0.60 | 0.60 | |
| Amylase[5] | 0.35 | 0.35 | |
| Plurafac ® LF 403[6] | 0.20 | 0.20 | |
| Citric Acid | | | 4.0 |
| Wax[7] | | | 2.0 |

[1]Acrylate/maleate copolymer ex. BASF
[2]Polyacrylate ex BASF
[3]N,N,N',N'-tetraacetylethylene diamine
[4]Savinase ® 6T ex Novo
[5]Termamyl ® 60T ex Novo
[6]Surfactant ex BASF
[7]Boler ® 1397, m.pt. 42–46° C.

The tablets were evaluated in the N55 cycle of a Bauknecht dishwashing machine. This machine was selected because it traditionally delivers high glass filming scores. The tablets were introduced into the machine via a basket hanging from the top rack. Glass tumblers were evaluated for filming using the visual scoring system where filming is rated from 0 (no film) to 5 (heavy film). The permanent wash water hardness was 300 ppm (4:1 calcium/magnesium expressed as calcium carbonate) and the temporary wash water hardness (bicarbonate) was 320 ppm. The glasses were washed up till 6 cycles.

For Tablet E, the pH throughout the main wash was 9.8 to 9.9. For Tablet F, the pH of the wash water was 9.4 to 9.6 after 5 minutes of the main wash and 8.4 to 8.5 after 10 minutes of the main wash.

The results of the cleaning evaluation are summarized in Table 4.

TABLE 4

| | Filming on Glasses | | |
|---|---|---|---|
| Tablet | Run #2 | Run #4 | Run #6 |
| E | 2.0 | 2.4 | 3.0 |
| F | 1.5 | 2.2 | 2.5 |

Even under stressed conditions, the advantage of the technology of the current invention is seen. For Tablet E, which is outside the scope of this invention, there is no controlled release of acidity source. Thus, in Tablet E, the pH is maintained above pH 9.5 throughout the wash which is not beneficial for prevention of scaling. In Tablet F, which lies within the scope of this invention, controlled release of an acidity source allows for a high initial wash pH, which is traditionally beneficial for bleaching and soil removal, and a controlled drop in wash pH for good glass appearance by virtue of reduced scaling.

We claim:

1. A machine dishwashing detergent tablet comprising:

a) a first layer having:

(i) an oxygen bleach system;

(ii) a buffering system;

(iii) about 5 wt. % to about 90 wt. % of a builder; and (iv) an effective amount of an enzyme, wherein the first layer at least partially dissolves in the main wash of the dishwashing cycle to deliver a pH of about 8.5 to about 11 in the wash water; and b) a second layer having:

(i) an acidity agent; and (ii) a material of a continuous medium which is a carrier for the acidity agents and has a melting point in the range of from about 35° C. to about 50° C., wherein the second layer dissolves subsequent to partial dissolution of the first layer in the main wash of the dishwasher to deliver a pH of from about 6.5 to about 9 in the wash water.

2. The detergent composition according to claim 1 wherein the oxygen bleach system is selected from the group consisting of a peracid, a peracid precursor, hydrogen peroxide source, a diacyl peroxide, a bleach catalyst and mixtures thereof.

3. The detergent composition according to claim 2 wherein the peracid is selected from the group consisting of a peroxybenzoic acid, ring substituted peroxy benzoic acid, aliphatic monoperoxy acid, substituted aliphatic monoperoxy acid and mixtures thereof.

4. The detergent composition according to claim 3 wherein the peracid is phthalimido peroxy hexanoic acid or o-carboxybenzamido peroxy hexanoic acid.

5. The detergent composition according to claim 1 wherein the acidity agent is selected from the group consisting of monocarboxylates, dicarboxylates, polycarboxylates, boric acid, alkali metal salts of bicarbonate, alkali earth metal salts of bicarbonate, hydrogen sulfate, hydrogen phosphate, organo phosphoric acids and mixtures thereof.

6. The detergent composition according to claim 1 wherein the material is selected from the group consisting of a paraffin wax, a natural wax, a polyvinyl ether, fatty acids and mixtures thereof.

7. The detergent composition according to claim 6 wherein the material selected is a polyvinyl ether and wherein such polyvinyl ether has a formula:

$$[C_xH_{2x}O]_y$$

wherein x is an integer from 18 to 22 and y is an integer from 150 to 300.

8. The detergent composition according to claim 1 wherein the first layer further comprises from about 0.5 to about 30% by wt. of a surfactant.

9. The detergent composition according to claim 1 wherein the first layer further comprises a compound selected from the group consisting of a sequestrant, an anti-sealant, an antifoaming agent, binders, disintergrants, lubricants, an enzyme stabilizing agent, a soil suspending agent, an antiredeposition agent, an anticorrosion agent, a decor care enhancer, a colorant, a perfume and mixtures thereof.

10. The detergent composition according to claim 1 wherein the tablet has more than two layers.

11. The detergent composition according to claim 1 wherein the buffering system is a material selected from the group consisting of water soluble alkali metal carbonate, bicarbonate, sesquicarbonate, borate, silicate, layered silicate, metasilicate, phytic acid, borate, crystalline alluminum silicate, amorphous aluminum silicate and mixtures thereof.

* * * * *